US005931133A

United States Patent [19]

Giannone et al.

[11] Patent Number: 5,931,133

[45] Date of Patent: Aug. 3, 1999

[54] ROLLER CAM FOLLOWER BEARING SHAFT RETENTION

[75] Inventors: Guy Ernest Giannone, Bergen; Gary Donnell Blake, Rochester; Richard Blanco Roe, Henrietta, all of N.Y.; Ralph Lyle Clayson, III, Grand Rapids, Mich.

[73] Assignee: General Motors Corporation, Detroit, Mich.

[21] Appl. No.: 09/080,421

[22] Filed: May 18, 1998

[51] Int. Cl.[6] ..... F01L 1/14; F01L 1/18

[52] U.S. Cl. ..... 123/90.5; 123/90.42; 74/569

[58] Field of Search ..... 123/90.48, 90.5, 123/90.51, 90.39, 90.42; 384/584; 74/569

[56] References Cited

U.S. PATENT DOCUMENTS 5,261,361 11/1993 Speil ..... 123/90.5

5,273,005 12/1993 Philo et al. ..... 123/90.5

5,385,124 1/1995 Hillebrand et al. ..... 123/90.5

*Primary Examiner*—Weilun Lo

*Attorney, Agent, or Firm*—Karl F. Barr, Jr.; Vince A. Cichosz

[57] ABSTRACT

A cam follower roller bearing shaft is restrained against lateral motion in shaft support bores of the follower body by plugging the bore ends with retainer plugs in or adjacent the ends of the bores. Soft metal or plastic bearing materials may be pressed or molded in the bore ends or in recesses in the follower body at the ends of the bores. Other forms of mechanical retention are disclosed. A fixture for pressing in plugs cut from plastic strips is also disclosed. Applications of the plugs in roller valve lifters, roller finger followers and rocker arm roller followers are disclosed.

16 Claims, 5 Drawing Sheets

FIG-4
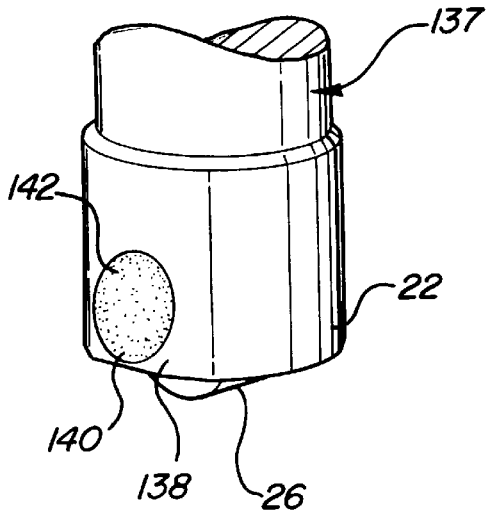
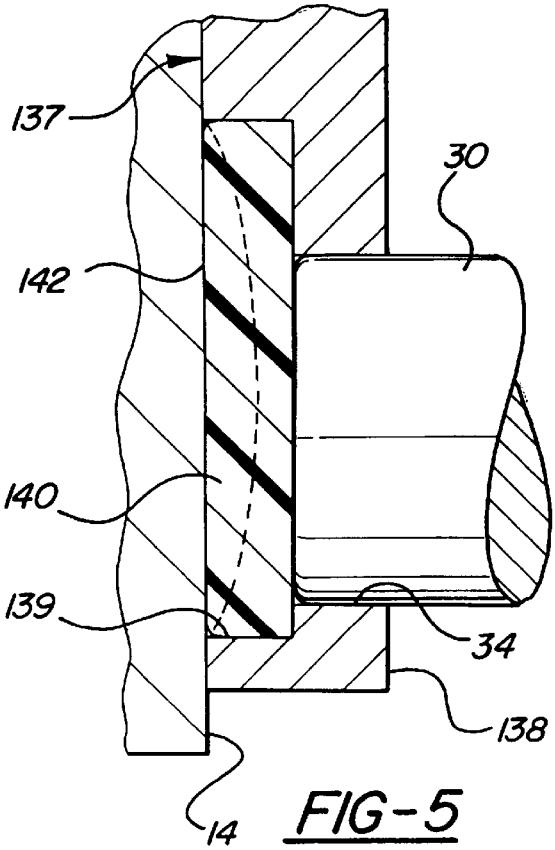
FIG-5
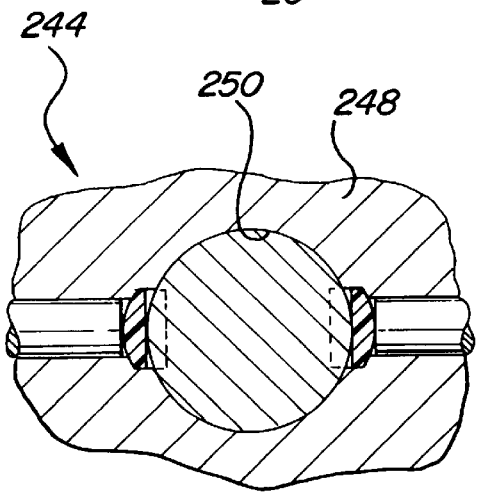
FIG-6
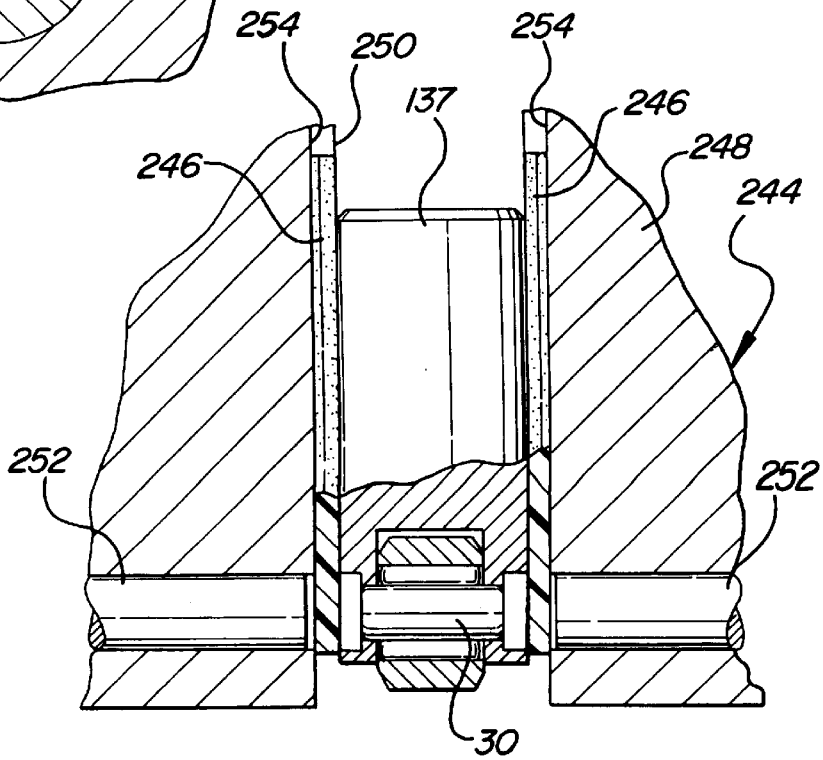
FIG-7

ROLLER CAM FOLLOWER BEARING SHAFT RETENTION

TECHNICAL FIELD

This invention relates to roller cam followers for engines including, for example, roller rocker arms, roller finger followers and roller valve lifters for engines including hydraulic valve lifters. In particular, the invention relates to means and methods for retaining a roller bearing shaft against axial movement in a follower body.

BACKGROUND OF THE INVENTION

It is known in the art relating to roller cam followers, such as roller hydraulic valve lifters and finger followers to provide a steel roller bearing shaft supporting a cam follower roller and retained in laterally spaced shaft bores in a follower body. To prevent lateral motion of the shaft, it may be selectively hardened to maintain the ends soft enough to be deformed by a riveting tool which locks the shaft in position in the follower body shaft bores. This assembly method requires care to provide adequate upset of the shaft ends to retain the shaft without causing distortion of the mating body or arm support structure.

SUMMARY OF THE INVENTION

The present invention provides improved means and methods for retaining a roller cam follower shaft against lateral motion in a body without requiring selective hardening or being subject to deformation of the body during manufacturing. This is accomplished by providing retainer plugs which mount in the follower body in or adjacent the ends of the shaft bores so as to lock the roller shaft in its lateral position.

In an engine valve lifter, the retainer plugs may be made of soft or hardened metal or bearing type plastic, such as nylon, and may be mounted in recesses provided in the outer sides of the body or directly in the ends of the bores themselves. The retainer plugs may be pressed directly into the ends of the shaft bores or into recesses around the bores. Plastic or soft metal retainers are preferred for mounting in recesses in the body walls wherein the exteriors of the retainer plugs are shaped to match the cylindrical outer surface of the lifter body and to bear directly against an associated lifter gallery bore in which the valve lifter is reciprocably mounted. Special assembly machinery may be provided to punch retainer plugs directly out of a plastic strip and force them into the lifter recesses. Optionally, the retainer plugs may extend axially above the shaft bores toward the valve actuating end of the lifter so as to increase the length of bearing of the retainer plugs in the lifter gallery bore. This will assist in holding the plugs, and thus the shaft, in place when the lifter is on the cam base circle and the shaft openings extend at least partially out of the lifter gallery bore.

In a roller finger follower or a rocker arm roller follower, metal or plastic plugs may be similarly used to block the ends of the roller shaft bores and retain the shaft against lateral motion therein.

These and other features and advantages of the invention will be more fully understood from the following description of certain specific embodiments of the invention taken together with the accompanying drawings.

BRIEF DESCRIPTION OF THE DRAWINGS

In the drawings:

FIG. 4 is a pictorial view of the roller end of an alternative embodiment of lifter according to the invention;

FIG. 5 is a transverse cross-sectional view along the axes of the lifter body and roller shaft of the lifter of FIG. 4;

FIG. 6 is a horizontal cross-sectional view illustrating an assembly fixture for the mounting of retainer plugs in a valve lifter;

FIG. 7 is an axial cross-sectional view through the assembly fixture of FIG. 6;

DESCRIPTION OF THE PREFERRED EMBODIMENT

Figure 1:
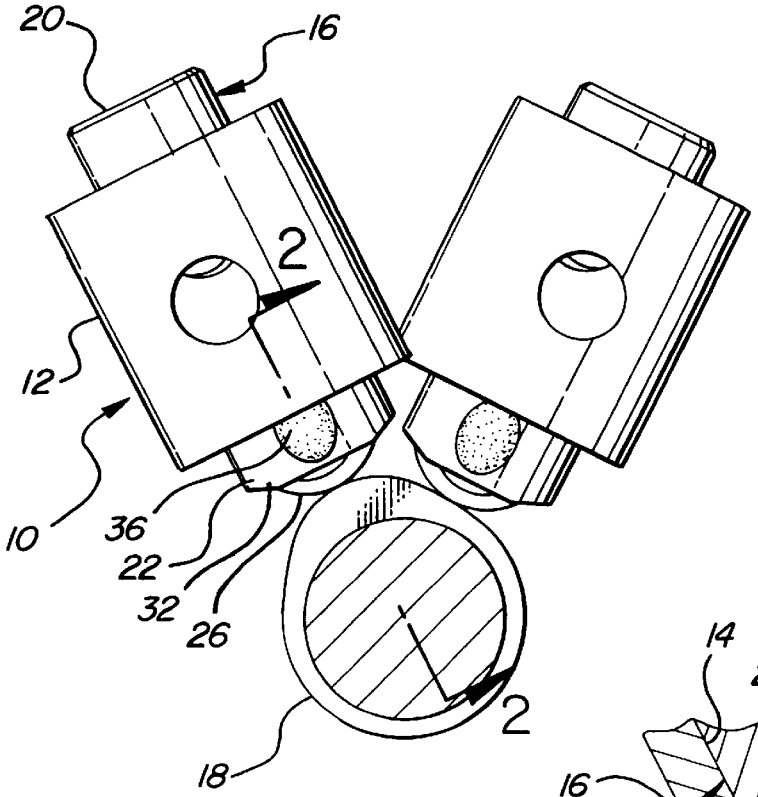
FIG. 1 is a transverse cross-sectional view through the lifter gallery and cam shaft of an internal combustion engine showing the mounting and construction of a roller hydraulic valve lifter having retainer plugs according to the invention.
Figure 3:
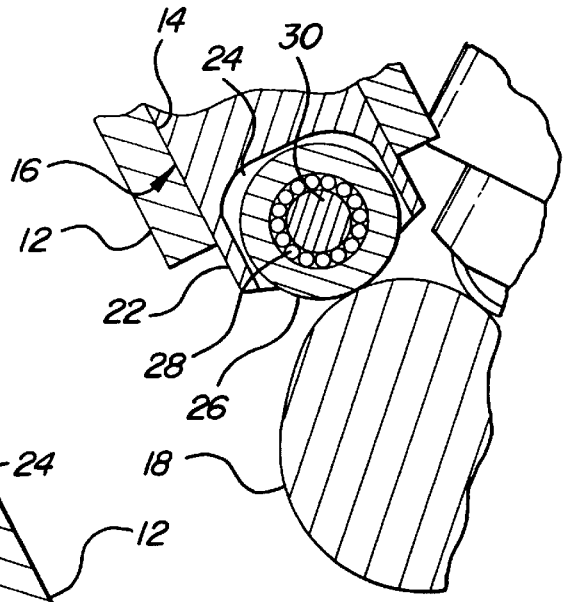
FIG. 3 is a transverse cross-sectional view from the line 3—3 of FIG. 2.
Figure 2:
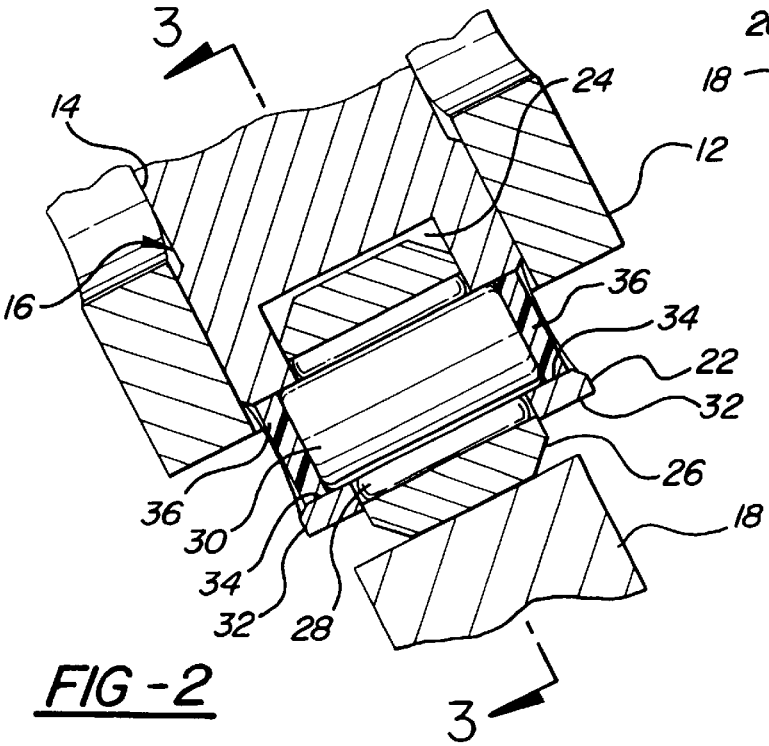
FIG. 2 is a cross-sectional view from the line 2—2 of FIG. 1.

Referring first to FIGS. 1–3 of the drawings in detail, numeral 10 generally indicates a portion of an internal combustion engine having a lifter gallery 12 forming part of an engine cylinder block and having a plurality of cylindrical bores 14. A roller hydraulic valve lifter 16 is reciprocably received in each of the bores and engages a cam 18 of a camshaft for reciprocably actuating the valve lifter to open and close an engine valve, not shown.

The valve lifter 16 includes a first cylindrical end 20 adapted to engage a push rod or other means for connection of the lifter with an engine valve, not shown. The lifter 16 also includes a second cylindrical end 22 defining an internal pocket 24 in which a follower roller 26 is received. Roller 26 rides on needle roller bearings 28 which roll on a transverse shaft 30 having a surface of hardened steel. Other forms of bearings could be used if desired. The shaft 30 extends transversely between opposite sides 32 of the lifter body which are separated by the pocket 24. Opposite ends of the shaft 30 are received in transversely aligned shaft bores 34 formed in the sides 32.

In accordance with a first embodiment of the invention, the shaft 30 is retained in the bores 34 and prevented from moving axially therein by soft or hardened metal plugs 36 which are pressed into the bores 34 and held in place by an interference fit. The plugs 36 are recessed within the sides 32 of the lifter body so that they do not engage the bore 14 of the lifter gallery. Alternatively, plugs made of soft metal or plastic could extend to the outer diameter of the lifter body and be machined or otherwise shaped thereto so that they can slide against the lifter gallery bore 14 without causing excessive wear or scoring therein.

In operation, the follower roller 26 follows the profile of the rotating cam 18, causing the valve lifter 16 to reciprocate vertically within the bore 14 in order to open and close the associated engine valve, not shown. The metal plugs 36 maintain the roller bearing shaft 30 in position, thus preventing it from sliding laterally along its axis into engagement with the lifter gallery bore. Note that the location of the shaft 30 along the axis of the lifter is such that the shaft bores may be partially or wholly below the lower end of the lifter gallery bore 14 during all or part of the valve operation cycle. Because the shaft 30 is retained in the bores 34 by the pressed in plugs 36, the shaft 30 itself may be fully hardened without the requirement for maintaining soft ends for deformation as in the prior art embodiment.

Referring now to FIGS. 4 and 5 of the drawings, there is shown an alternative embodiment of the invention wherein like reference numerals indicate like parts. In this embodiment a roller hydraulic valve lifter 137 is received in the lifter gallery bore 14 for reciprocation therein as before. Valve lifter 137 includes a follower roller 26, omitted in FIG. 5, which is rotatably supported on a fully hardened roller bearing shaft 30 received in shaft bores 34 in the sides 138 of the lifter body. At the ends of the shaft 30, enlarged recesses 139 are provided, opening to the outer surface of the lifter body. The recesses are circular and offset upwardly from the axes of the shaft 30 and bores 34 so that the recesses 139 extend further above the shaft than below. The recesses are filled by plugs 140 of suitable plastic bearing material, such as nylon or the like, which may be pressed into the recesses 139. Alternatively, the plugs 140 would be molded in place. The outer surfaces 142 of the plugs are preferably curved arcuately to align with the cylindrical surface of the lower or second end 22 of the lifter body so that the plugs and their associated recesses 139 are thinner at their peripheral outer edges than at their centers, as shown in the cross-sectional view of FIG. 5.

The purpose of offsetting the recesses 139 and the location of the associated plastic plugs 140 is to extend a greater surface area of the plugs up into the lifter gallery bores so that the plugs are positively retained in place by engagement with the bores at all times during operation of the lifter in its reciprocating motion.

Figure 8:
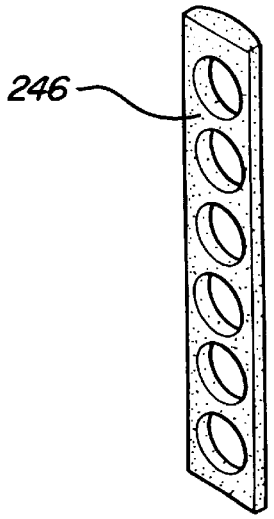
FIG. 8 is a pictorial view of a plastic punch strip showing openings from which retainer plugs were punched during use in the fixture of FIGS. 6 and 7.

FIGS. 6–8 illustrate features of a fixture 244 and associated punch strip 246 for use in pressing plugs, such as plastic plugs 140, into the recesses 139 of an associated valve lifter 116. Fixture 244 includes a body 248 having a bore 250 for receiving a partially assembled hydraulic valve lifter 116. Punches 252 extend through lateral openings in the body 248 which intersect vertical grooves 254 formed along either side of the bore 250. In the grooves are received the plastic punch strips 246 which have preconfigured arcuate outer surfaces and flat inner surfaces. The grooves 254 are located on diametrically opposite sides of the bore 250.

In operation, a partially assembled valve lifter 116 is inserted into the bore 250 with its roller shaft recesses 139 aligned with the grooves 254 and punches 252. Plastic punch strips 246 are located in the grooves with their lower ends adjacent the plug recesses 139 of the lifter. The punches 252 are then actuated inward, punching a disc of plastic material out of each punch strip 246 and pressing it into the adjacent recess of the valve lifter to finish the assembly process and retain the roller shaft 30 in the lifter. The curved outer surface of the plastic material as preformed in the punch strip 246 aligns with the outer surface of the lifter lower end 22 without the need for further machining, although such machining could be provided if desired.

Figure 9:
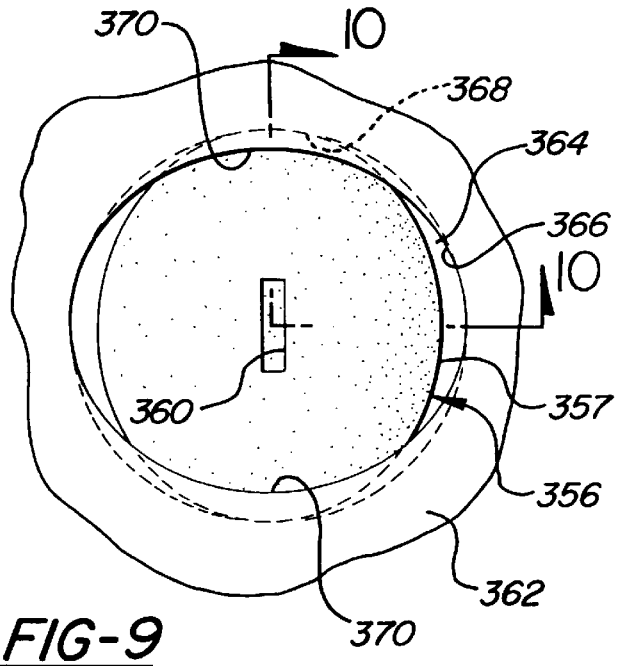
FIG. 9 is a fragmentary side view of a lifter mounting an alternative embodiment of retainer plug in accordance with the invention.
Figure 10:
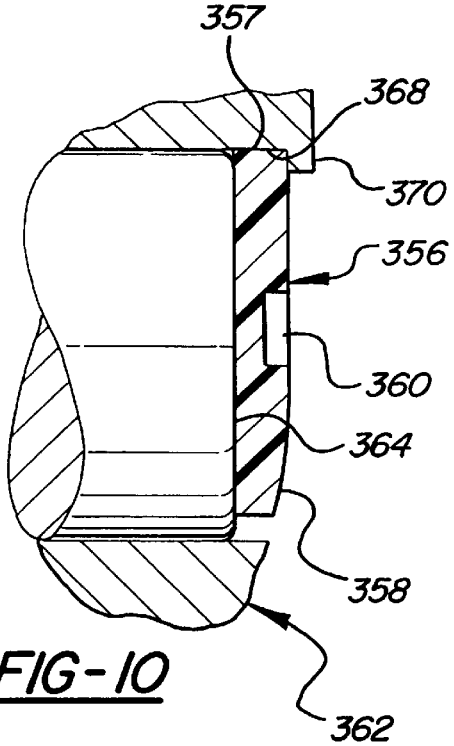
FIG. 10 is a cross-sectional view from the line 10—10 of FIG. 9 illustrating the manner of retention of the retainer plugs.
Figure 11:
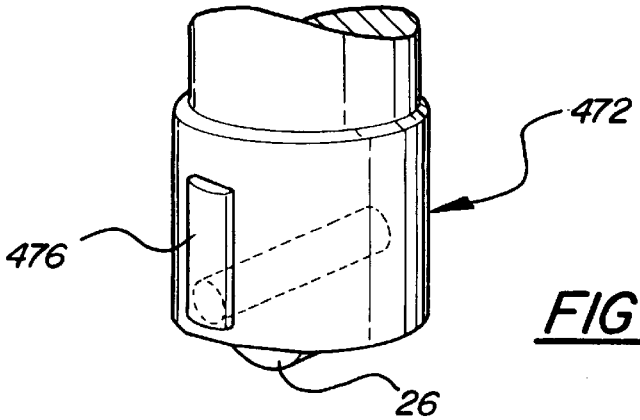
FIG. 11 is a pictorial view similar to FIG. 4 but showing another embodiment of lifter with retainer plugs extending axially above the body shaft bores.
Figure 12:
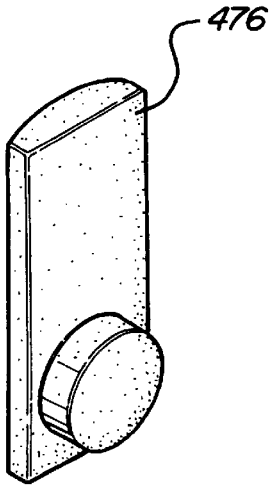
FIG. 12 is a pictorial view from the inner side of a retainer plug of FIG. 11.

FIGS. 9 and 10 disclose another embodiment of retainer plugs and mounting in accordance with the invention. In this embodiment retainer plugs 356 are made with an oval shaped periphery 357 and a cylindrical outer surface 358 formed about an axes parallel with the long dimension of the oval. A slot 360 is formed in the central outer surface of each retainer plug for receiving a screwdriver or similar tool. The associated valve lifter 362 is provided with formed recesses 364 located adjacent roller shaft bores as before. The recesses have oval shaped outer openings 366 with circular lower portions 368 of a diameter sufficient to receive the long axes of the oval plugs 356. These circular lower portions 368 are formed by undercutting the outer openings leaving overhanging lips 370 along the narrow upper and lower portions of the outer openings 366.

In use, the preformed retainer plugs 356 are inserted into the outer openings 366 with the long sides of their oval configuration in a horizontal position. Once in the recesses 364, the retainer plugs 356 are rotated by a screwdriver or other tool in the slot 360, turning the plugs 90 degrees so that the edges of the long portions of the oval are slid under the lips 370 and the retainer plugs 356 are then held in position with their long sides vertical, the edges of these sides being locked in place by the lips 370 of the outer openings 366.

FIGS. 11–15 illustrate yet another embodiment of the invention wherein a roller hydraulic valve lifter 472, carrying a roller 26 on a shaft 30 seated in shaft bores 34, is provided with recesses 474 in the form of broached flats, machined into the outer surface of the lifter body adjacent the shaft bores 34. The recesses 474 are generally rectangular and extend substantially above the shaft bores 34 radially with respect to the shaft axis.

Figure 13:
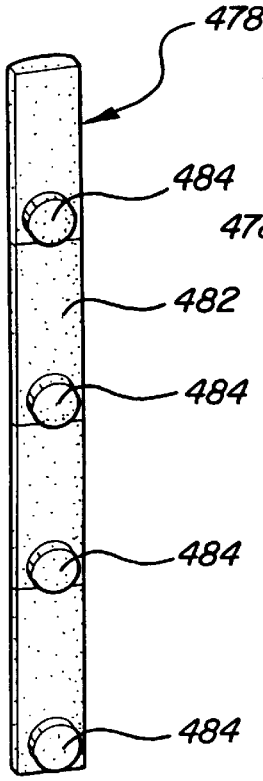
FIG. 13 is a pictorial view of a strip of retainer plugs for mounting by a punch fixture.
Figure 14:
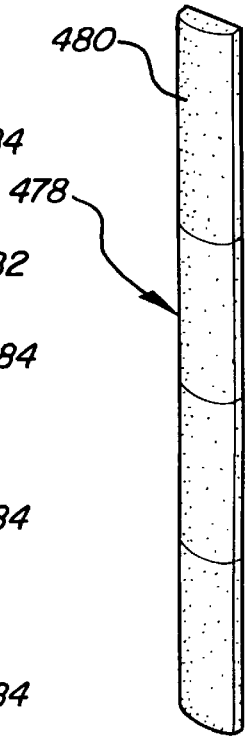
FIG. 14 is a pictorial view of the exterior arcuate configuration of the retainer plug strip.
Figure 15:
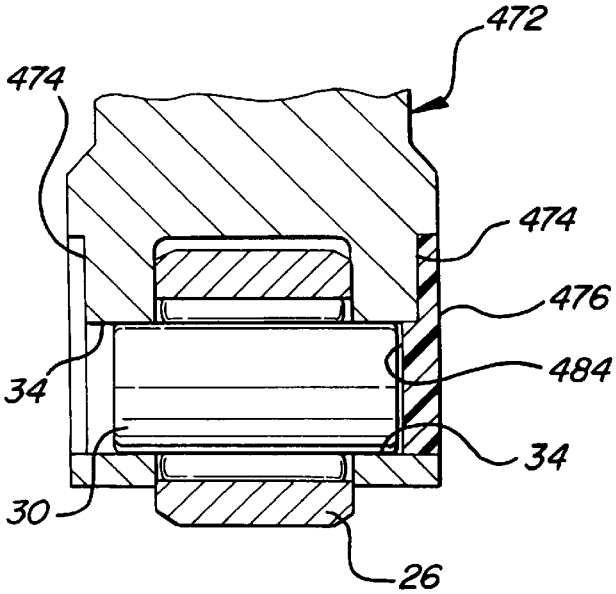
FIG. 15 is a cross-sectional view showing the position of the retainer plug of FIG. 12 in a lifter body.

Within the recesses 474, there are located retainer plugs 476 (only one shown) formed from pre-machined punch strips 478. As shown in FIGS. 13 and 14, punch strips 478 have preformed arcuate outer surfaces 480 and flat inner surfaces 482 from which, near their lower ends, extend circular protrusions 484 sized to be received within the shaft bores 34. The punch strips 478 are also characterized by a radially extending portion substantially complementary with the recesses 474.

In assembly, the retainer plugs 476 may be installed by separation from punch strips in the manner described with respect to the embodiment of FIGS. 6–8. The retainer plugs have their protrusions 484 pressed into the ends of the shaft bores 34 while the flat inner surfaces 482 are seated against the broached flats on the sides of the lifter body and the arcuate outer surfaces 480 are aligned with the cylindrical outer surface at the lower ends of the lifter body.

Figure 16:
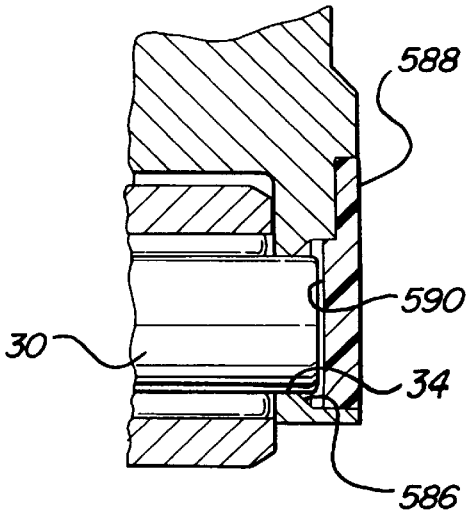
FIG. 16 is a cross-sectional view similar to FIG. 15 but showing still another embodiment of retainer plug in a lifter body.

FIG. 16 illustrates still another alternative embodiment which differs from that of FIGS. 11–15 only in that counterbores 586 are formed at the outer ends of the shaft bores 34 and the retainer plugs 588 are provided with circular protrusions 590 that are large enough to fit within the counterbores 586.

In another alternative embodiment not shown, the broached flats forming recesses 474 are replaced by grooves spot faced into the sides of the lower end of the lifter.

Figure 17:
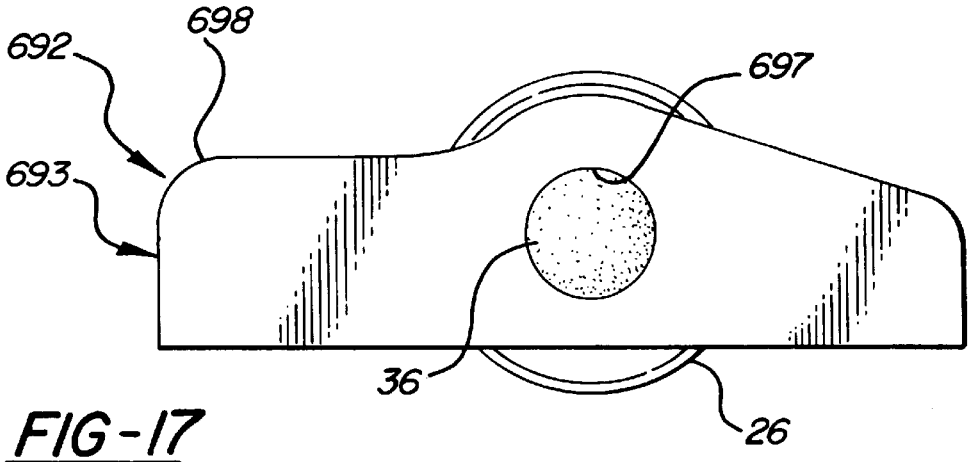
FIG. 17 is a side view of a roller finger follower having retainer plugs in accordance with the invention.
Figure 18:
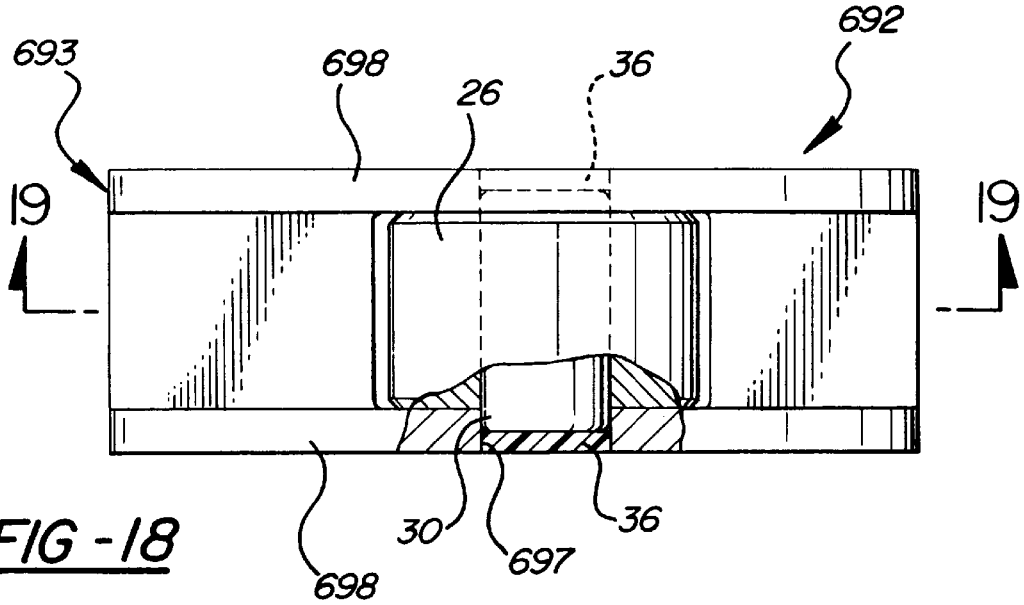
FIG. 18 is a top view of the follower of FIG. 17 partially broken away to show one of the retainer plugs.
Figure 19:
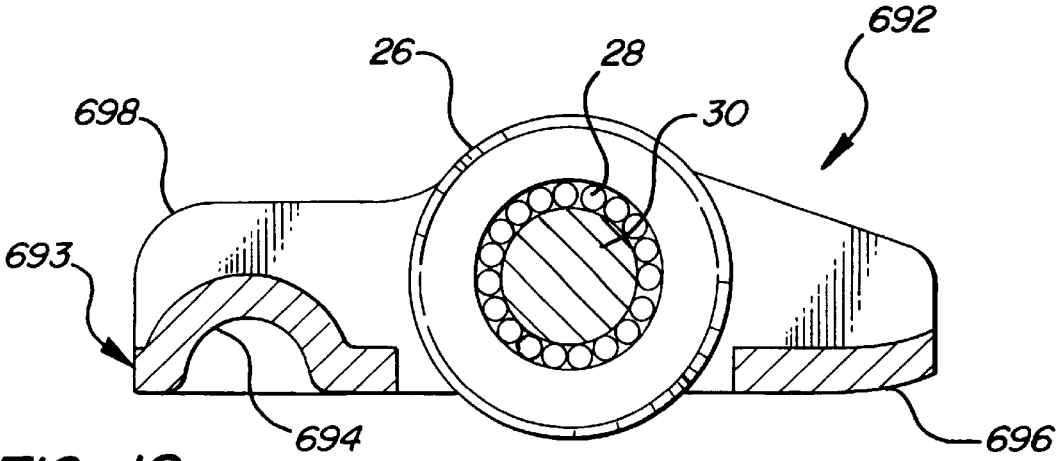
FIG. 19 is a cross-sectional view from the line 19—19 of FIG. 18.

Referring now to FIGS. 17–19, there is shown a roller finger follower for use in engine valve gear and generally indicated by numeral 692. Finger follower 692 also includes shaft retention means according to the invention and is shown as exemplary of various other forms of roller followers to which the retainer plugs of the present invention may be applied. These could also include, for example, engine valve rocker arms having a roller follower.

Finger follower 692 includes a channel shaped body 693 formed with a pivot recess 694 at one end and an actuating pad 696 at the other end. Recess 694 is engageable with a pivot or the plunger of a stationary hydraulic lash adjuster in an engine cylinder head, not shown. Pad 696 is engageable with a valve stem, not shown, for opening the valve when the follower is actuated. A cam follower roller 26 is carried on needle roller bearings 28 movable on a hardened shaft 30 supported in bores 697 through sides 698 of the body 693. Lateral movement of the shaft 30 in the openings 697 is prevented by metal plugs 36 pressed into the bores 697 as discussed in connection with the embodiment of FIGS. 1–3. Other forms of plugs in accordance with the invention could be substituted for the metal plugs if desired.

While the invention has been described by reference to certain preferred embodiments, it should be understood that numerous changes could be made within the spirit and scope of the inventive concepts described. Accordingly it is intended that the invention not be limited to the disclosed embodiments, but that it have the full scope permitted by the language of the following claims.

We claim:

1. An engine cam follower having a body with a cam follower roller rotatably mounted in a recess between opposite sides of the body on a transverse shaft supported in shaft bores through the sides, characterized by:

retainer plugs carried by the body and closing outer ends of the shaft bores to limit axial motion of the shaft in said shaft bores.

2. An engine cam follower as in claim 1 wherein said retainer plugs are pressed into said outer ends of the shaft bores.

3. An engine cam follower as in claim 1 wherein said retainer plugs are held against the shaft bores by mechanical interlocking with a portion of the follower body.

4. An engine cam follower as in claim 1 wherein said cam follower is a valve lifter and said retainer plugs have outer surfaces adapted to engage a lifter gallery bore for retaining the plugs against the shaft bores when assembled in an engine.

5. An engine cam follower as in claim 4 wherein said outer surfaces of the retainer plugs are cylindrically curved to conform to the associated lifter gallery bore.

6. An engine cm follower as in claim 4 wherein said retainer plugs have radially extending portions that extend radially beyond the shaft bores in at least one direction and said radially extending portions are received in recessed portions of the body sides adjacent the outer ends of the shaft bores.

7. An engine cam follower as in claim 6 wherein said retainer plugs include insert portions extending into the shaft bores and connecting with the radially extending portions.

8. An engine cam follower as in claim 6 wherein said radially extending portions of the retainer plugs extend axially from the shaft bores toward a valve actuating end of the body for maintaining the retainer plugs in the body recessed portions when the lifter is positioned with its shaft bore at least partially beyond the lifter gallery bore.

9. An engine cam follower as in claim 1 wherein said retainer plugs are engageable with a wall of an associated lifter gallery and are made of metal softer than said wall.

10. An engine cam follower as in claim 1 wherein said retainer plugs are made of plastic bearing material.

11. An engine cam follower as in claim 10 wherein said retainer plugs are punched from a preformed strip directly into their positions on the lifter body.

12. An engine cam follower as in claim 1 wherein said retainer plugs are oblong and are received in recesses with oblong outer openings and turned at an angle to engage undercut lips of the recesses that retain the plugs in the recesses.

13. An engine cam follower as in claim 1 wherein said cam follower is a roller finger follower.

14. An engine cam follower as in claim 13 wherein said retainer plugs are made of a metal.

15. An engine cam follower as in claim 13 wherein said retainer plugs are made of a plastic material.

16. An engine cam follower as in claim 15 wherein said retainer plugs are punched from a preformed strip directly into their positions on the followers body.

* * * * *